US006912777B2

(12) United States Patent
Carlson et al.

(10) Patent No.: US 6,912,777 B2
(45) Date of Patent: Jul. 5, 2005

(54) METHOD OF MANUFACTURING A HIGH-PERFORMANCE, WATER BLOCKING COAXIAL CABLE

(75) Inventors: Bruce Carlson, Chicago, IL (US); Jack L. Knowles, Kissimmee, FL (US); James Krabec, Oak Lawn, IL (US); Leonard Visser, New Lenox, IL (US)

(73) Assignee: Andrew Corporation, Orland Park, IL (US)

( * ) Notice: Subject to any disclaimer, the term of this patent is extended or adjusted under 35 U.S.C. 154(b) by 82 days.

(21) Appl. No.: 10/294,045

(22) Filed: Nov. 14, 2002

(65) Prior Publication Data

US 2003/0201116 A1 Oct. 30, 2003

Related U.S. Application Data

(62) Division of application No. 10/131,747, filed on Apr. 24, 2002, now Pat. No. 6,693,241.

(51) Int. Cl.[7] ..... H01B 13/20

(52) U.S. Cl. ..... 29/828; 29/728; 156/51; 156/79; 156/207; 174/102 D; 264/46.4; 264/46.9

(58) Field of Search ..... 29/728, 828; 138/121; 174/28, 102 D, 102 R, 106 R; 264/45.9, 46.1, 46.4, 46.9, 272.11, 321; 427/117–120; 156/48, 51, 79, 105–207

(56) References Cited

U.S. PATENT DOCUMENTS

| | | | | |
|---|---|---|---|---|
| 2,348,641 A | | 5/1944 | Parker | 174/102 |
| 2,623,121 A | | 12/1952 | Loveridge | 178/44 |
| 2,876,801 A | | 3/1959 | November | 138/50 |
| 3,173,990 A | | 3/1965 | Lamons | 174/102 |
| 3,287,490 A | | 11/1966 | Wright | 174/102 |
| 3,394,400 A | | 7/1968 | Lamons | 174/102 |
| 3,582,536 A | | 6/1971 | Miller | 174/102 |
| 3,968,918 A | * | 7/1976 | Merle | 228/148 |
| 4,270,961 A | * | 6/1981 | Faranetta et al. | 174/107 |
| 4,368,350 A | | 1/1983 | Perelman | 174/102 D |
| 4,435,968 A | * | 3/1984 | Roderburg | 72/77 |
| 4,712,642 A | | 12/1987 | Lalikos et al. | 181/207 |
| 5,515,603 A | * | 5/1996 | Ziemek et al. | 29/828 |
| 6,037,545 A | | 3/2000 | Fox et al. | 174/110 R |
| 6,137,058 A | | 10/2000 | Moe et al. | 172/102 R |
| 6,289,581 B1 | | 9/2001 | Pote | 29/828 |

* cited by examiner

*Primary Examiner*—Peter Vo
*Assistant Examiner*—Donghai D. Nguyen
(74) *Attorney, Agent, or Firm*—Welsh & Katz, Ltd.

(57) ABSTRACT

A helical corrugated coaxial cable possesses low cost of manufacture comparable to that of braided shield coaxial cable, electrical performance comparable to solid tubular shielded cable, flexibility of helical and annular corrugated cable, and fluid blockage comparable to annular shielded cable. The cable has an inner conductor surrounded by a foam dielectric insulator. A tubular shield surrounds the dielectric and has helical corrugations penetrating into and compressing the foam dielectric to effectively suppress the formation of fluid migration air gaps or passageways between the shield and the dielectric. The shield is preferably composed of aluminum or aluminum alloy. Alternatively, the shield may be annularly corrugated for improved water blocking performance. The manufacturing process employs high speed welding and multi-lead corrugating operations to reduce cost.

16 Claims, 4 Drawing Sheets

METHOD OF MANUFACTURING A HIGH-PERFORMANCE, WATER BLOCKING COAXIAL CABLE

CROSS-REFERENCE TO RELATED APPLICATIONS

This application is a divisional application of application Ser. No. 10/131,747, filed Apr. 24, 2002, entitled Low-Cost, High Performance, Moisture-Blocking, Coaxial Cable and Manufacturing Method, now U.S. Pat. No. 6,693,241.

BACKGROUND

The field of invention is coaxial cables having an inner conductor, a foam dielectric material formed about the inner conductor, and a shield formed about the dielectric material.

Coaxial cable is commonly used for many applications, such as transmission of radio frequency signals, cable television signals and cellular telephone broadcast signals. A coaxial cable of the type with which this invention concerns includes an inner conductor, a foam-type dielectric around the inner conductor, an electrically conductive shield surrounding the dielectric foam and serving as an outer conductor, and a protective jacket which surrounds the shield. The foam dielectric electrically insulates the inner conductor from the surrounding shield.

Commercially available coaxial cables which address the cost-sensitive mass market (exclusive of special purpose cable products) comprise basically four types: 1) braided shield cable; 2) smooth-walled cable; 3) annular corrugated cable; and 4) helical corrugated cable.

Braided shield cable is the lowest cost product and has excellent flexibility, however, it suffers badly in electrical properties. The braided shield has poor shielding effectiveness due to the porous woven nature of the shield, and typically requires the addition of a conductive foil under the braided shield to achieve even marginally acceptable shield effectiveness. Further, braided shield cable is ineffective in resisting intrusion of fluids, as the braid will actually "wick" fluids through the cable. The water blocking properties of braided shield cable can be improved by impregnating the braid with heavy grease, however this step raises the cost of the product. The braided shield is a loose braid that results in inconsistent contacts that creates non-linear joints. The effect of this is intermodulation, which is a type of noise or interference that is injected into the cable. Furthermore as noted, "waterproofing" of braided cable requires the addition of a grease type material with the braid. However, this is a drawback in that it results in difficulty is attaching connectors to the cable, because the grease is emitted by the cable during attachment of the connector. Also, over time the cables are known to leak grease due to cracks or damage to the cable, and create an environmental problem.

"Smooth-walled" cable, as it is termed, typically comprises an aluminum tube as a shield and outer conductor. It is more costly than braided shield cable, however, because the shield is a solid tube, the shield effectiveness of this cable type is excellent. This product, however, has poor flexibility, requiring special tools to bend it, and suffers from intolerable kinking if the bends are not formed properly. Any such kinking dramatically impairs the electrical properties of the cable. Smooth-walled cable shields are welded using an HF (high frequency) welding process, as HF welding permits much faster line speeds than the TIG (tungsten inert gas) welding process universally used in the manufacture of helical and annular corrugated cable (to be described).

Near the high end of commercial coaxial cable is helical corrugated cable. Helical corrugated cable has a shield composed typically of copper. To form the shield, copper sheet, is wrapped around a foam dielectric core and welded. The welded copper tube is then corrugated using a corrugating die, which spins around the tube and imparts the corrugations as the tube is advanced. This "single lead" corrugation process necessitates much slower line speeds than is possible with smooth-walled cable, but results in a much more flexible product than smooth-walled cable.

The use of copper as the shield material and the typically slow corrugation process drive up the cost of helical corrugated cable, however, its superior electrical and mechanical properties compensate in many applications for the increased cost. Helical corrugated cable suffers, however, by having less-than-optimum water blocking properties. Because the helical convolutions formed in the cable shield inherently create an uninterrupted passageway along the cable between the shield and the foam dielectric, water or other fluids entering the cable easily migrate along the cable. For this reason, helical corrugated cable is not recommended for use underground or in other aqueous environments.

At the high end of the four basic types of mass-marketed foam cable is annular corrugated copper cable. This product has all the attributes of helical corrugated copper cable, and in addition has improved water-blocking capability. Conventional copper annular corrugated cable with a foam dielectric, during its manufacture, has a tubular shield welded around foam dielectric with a space provided between the shield and the dielectric. The space is needed to permit the "gathering" of the tubular material, as in the manufacture of conventional copper helical corrugated cable. This space commonly leads to the capturing of air within the annual corrugations formed. However, despite the air gaps thus formed, because the corrugations are annular, like 360-degree rings, which contact the dielectric foam, each ring acts as a sort of seal, resists water migration. The superior water blocking ability of annular corrugated cable, relative to helical corrugated cable, permits it to be used underground and in more demanding aqueous environments than helical corrugated cable. Further, for a given depth of corrugation, annular corrugated cable is somewhat more flexible than helical corrugated cable.

However, there is a price to be paid for the improved water blocking and flexibility of annular corrugated cable compared with helical corrugated cable. The process of forming annular corrugations is much slower than the process of manufacturing helical corrugations. The resulting slower line speeds add significant manufacturing cost. For example, typical industry line speeds for corrugating annular shield cable may be 50 percent slower than industry line speeds for corrugating helical shield cable. Furthermore, the annular corrugating process does not lend itself to producing high pitch-to-depth ratio cable. Accordingly, annular corrugated cable tends to be less flexible than helical corrugated cable.

Until the present invention, we know of no product which meets all four of the desired foam coaxial cable attributes: 1) low cost; 2) electrical properties including shield effectiveness and intermodulation suppression comparable to that of solid tubular shielded cable; 3) mechanical properties, primarily flexibility, comparable to corrugated cable; and 4) water blockage comparable to annular corrugated cable.

PRIOR ART

Trilogy Communications, Inc. manufactures a coaxial cable for indoor use only that has an air dielectric design. The cable has an aluminum outer conductor and a copper clad aluminum inner conductor. However, because air is used as the dielectric, periodic spacers being used to separate the inner and outer conductors, these cables are highly susceptible to fluid migration and therefore cannot be used outdoors, or in any wet environment. Further, air-dielectric cable is more expensive to manufacture than foam dielectric cable.

The assignee of the present invention, circa 1984, supplied to the Department of Energy, United States Government, for use in the Nevada atomic test range, a special purpose cable designed to have extreme water and gas blocking capability in order to prevent ingress and migration of radioactive contamination. The cable comprised a copper clad aluminum inner conductor and a corrugated aluminum shield surrounding a foam dielectric. To maximize water and gas blocking performance, the aluminum shield was annular corrugated and employed adhesive between the shield and the foam dielectric. The shield had a thick wall; for 0.5 inch OD cable, the wall thickness was 0.016 inch; for ⅞ inch cable, the wall thickness was 0.020 inch or 0.025 inch depending upon the crush strength specified. The tungsten inert gas process used to weld the cable shield was almost an order of magnitude slower than the process capabilities of the cable of the present invention. For this reason, and a number of others, the cable was prohibitively costly and would not have been suitable for the mass consumption market.

Other aluminum annular helical corrugated cable is known, however, like the afore-described atomic test cable, it is characterized by having a thick-walled shield, for example, in the range of 0.016–0.020 inch—too thick to have the malleability needed in the practice of the present invention.

OBJECTS OF THE INVENTION

It is an object of the present invention to provide for the first time a cable which possesses all four of the above-stated desired attributes: 1) low cost; 2) electrical properties including shield effectiveness and intermodulation suppression comparable to that of solid tubular shielded cable; 3) mechanical properties, primarily flexibility comparable to corrugated cable; and 4) water blockage comparable to annular corrugated cable.

It is another object of the present invention to integrate in a novel and unique way an assemblage of cable material compositions, structural configurations and manufacturing processes to produce a coaxial cable with the lowest cost of any known cable with comparable electrical performance and flexibility.

It is another object of the present invention to produce such a cable having manufacturing cost comparable to that of braided shield cable products, and yet having the electrical properties, mechanical flexibility, and water blocking capability of more expensive coaxial cables.

It is an object to provide a helical corrugated coaxial cable possessing, for the first time, without the use of adhesives, water blocking performance exceeding any known helical corrugated cable not using adhesives or other special water blocking provisions.

It is still another object of the invention to provide a helical corrugated coaxial cable which can be manufactured at line speeds in excess of the line speeds of other known corrugated cable manufacturing processes.

It is yet another object of the invention to provide annular corrugated coaxial cable within which the formation of air gaps has been minimized or eliminated completely to thereby improve the water blocking performance of the cable compared to conventional annular corrugated cable.

It is yet another object of the invention to provide the first commercially practicable all-aluminum, foam dielectric, corrugated shield cable suitable in cost and performance for mass consumption.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

In the disclosure, the use of the disjunctive is intended to include the conjunctive. The use the definite article or indefinite article is not intended to indicate cardinality. In particular, a reference to the "the" object or "a" object is intended to denote also one of a possible plurality of such objects.

BRIEF DESCRIPTION OF THE DRAWINGS

The features of the present invention which are believed to be novel are set forth with particularity in the appended claims. The invention may best be understood by reference to the following description taken in conjunction with the accompanying drawings, in the several figures of which like reference numerals identify like elements, and in which:

DETAILED DESCRIPTION OF THE PREFERRED EXECUTION OF THE INVENTION

Figure 1A:
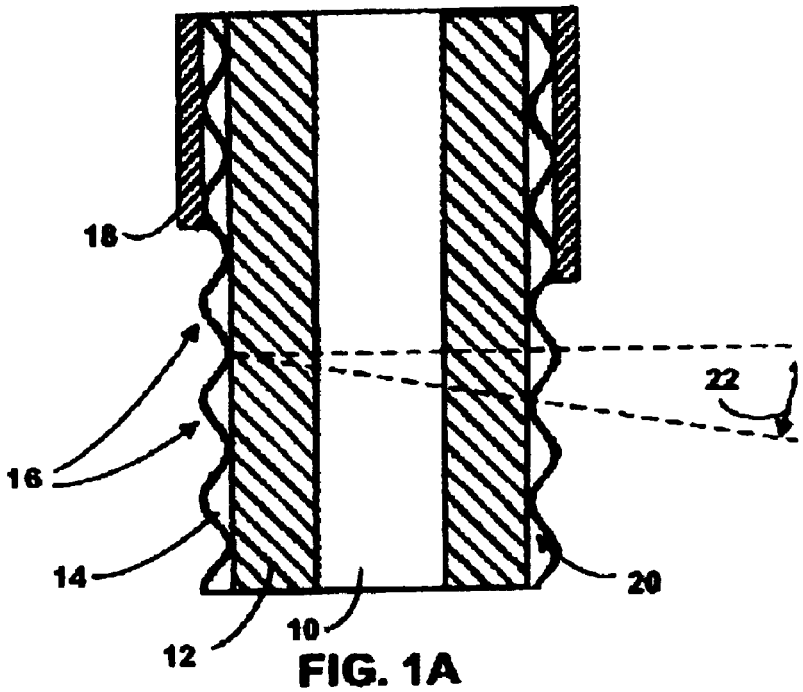
FIG. 1A PRIOR ART
FIG. 1*a* is a drawing depicting the various components of a prior art cable.

It is a stated object of the present invention to integrate in a novel and unique way an assemblage of cable material compositions, structural configurations and manufacturing processes to produce a coaxial cable with a hitherto unattainable combination of low cost, high performance, flexibility and environmental protection.

The cable of this invention is believed to have the lowest manufacturing cost of any known cable with comparable electrical performance and flexibility. Despite its extremely low cost, our cable has the performance attributes of more expensive coaxial cable—namely, 1) a solid tubular shield for maximum shielding effectiveness and intermodulation suppression, low VSWR and other electrical properties far superior to those found in traditional low cost braided shield cable; and 2) the superior flexibility of corrugated shields as compared with lower cost smooth-walled solid shield cable.

To attain the goal of a high performance, low cost coaxial cable with the superior collection of attributes described, we realized that we had to start with a solid tubular shield in order to achieve our high targeted shielding effectiveness and intermodulation suppression and other electrical properties. To obtain the necessary flexibility we saw no other way than to use some type of corrugated shield. The choice between helical and annular corrugation seemed to point to helical as it can be corrugated at higher line speeds than can annular corrugated cable. In general, single lead helical corrugation can be run at approximately twice the speed of running annular corrugation, and dual lead corrugation can be run at approximately twice the speed of running single lead helical corrugation. The task before us then, was to accomplish the often-unsuccessfully-sought goal of reducing the cost of manufacture down to that comparable to braided cable, and secondly to overcome the water migration problem inherent in helical corrugated cable.

A helical corrugation is characterized by depth and pitch. For a single lead corrugation, the helix advances one pitch in the direction of the cable axis as you trace the helix 360 degrees around the cable axis. Adjacent crests are formed from one helix. For a dual lead corrugation, two adjacent helixes are formed. Here each helix advances one pitch in the direction of the cable axis as you trace it 360 degrees around the cable axis, however, adjacent crests are part of two adjacent helixes. Thus a dual lead corrugation has twice the pitch to get the same number of crests per inch as a single lead corrugation. This may be extended to triple and more leads by adding more adjacent helixes and lengthening the pitch appropriately. This concept is very similar to that of a multiple-start thread.

Low Materials Cost

The unique coaxial cable of the present invention achieves low cost in a novel and unique way not found in the prior art in part by reducing material costs as much as possible. Reduced material cost is achieved according to the invention first by using the least possible amount of the more expensive high conductivity materials such as copper or silver. We use the high conductivity material only in the most critical location—namely as a cladding, coating or other deposit on the outer surface of the inner conductor.

In a preferred lowest cost embodiment of the invention, no copper or other high conductivity material is used in the outer conductor. We recognized that while the use of high conductivity material in the outer conductor is preferred for maximum electrical performance, it is not absolutely imperative and can be eliminated entirely without sacrificing acceptable electrical performance.

To further reduce material cost, even the base material—aluminum or aluminum alloy for example—is used in the least possible amount. To this end (and to meet other objectives to be described) the shield wall thickness is preferably no greater than about 0.012 inch in large diameter cable to a minimum wall thickness sufficient only to provide the necessary mechanical strength and weldability which for small diameter cable is in the range of 0.004 inch or less.

Low Cost Manufacturing Processes

Another essential aspect of the invention to achieve the described coaxial cable which has, compared with any known prior art, the lowest cost for a given level of electrical performance and flexibility, dramatically reduced manufacturing cost. This is achieved according to an aspect of the present invention primarily by maximizing line speed in a number of ways.

It has long been known that conventional "TIG" (tungsten inert gas) is the preferred method for welding conventional corrugated copper shielded coaxial cable. However, despite the fact that this invention utilizes corrugation of the shield for greater cable flexibility than smooth-walled cable, we have elected to use the HF (high frequency) welding technique traditionally used for welding smooth walled cable shields.

To obtain the high line speeds essential for low manufacturing cost, we elected to use HF welding because it is a much faster welding process than TIG welding. And, we have made this contrary choice with full knowledge that: 1) maximum ductility of the welded tube is critical to achieve our unique water blocking attribute (to be described below), but 2) HF welding of aluminum produces a less ductile weld seam. The HF welding process produces a less ductile seam than TIG welding because of the aluminum oxide artifacts and other impurities, which invade the weld joint. In short, by departing from the use of conventional TIG welding of corrugated shields to HF welding, we were able to remove the welding bottleneck to faster line speeds without unacceptably impairing the ductility needed for our improved water blocking performance.

The other impediment to high line speeds needed for low cost manufacture was the corrugation process. As noted, conventional shield corrugation is typically either annular or single-lead helical. Annular corrugated cable is the most flexible for a given corrugation pitch and depth, but is more costly to manufacture. Single lead corrugation is universally used for conventional helical copper corrugated cable. However, each of these traditional approaches to corrugating coaxial cable shields is too slow and would have prevented us from achieving our goal of the lowest cost coaxial cable having electrical performance and flexibility comparable to much more expensive corrugated copper cable.

To overcome this potential goal-killer, we thought that we could achieve acceptable flexibility and double line speeds by employing a dual lead helical corrugation. (In a dual lead helical process, two corrugations, rather than one, are formed for each turn of the corrugating die.) Known attempts in the industry to speed production of helical copper corrugated cable by using dual lead dies had failed. We reasoned that perhaps the failure was due to the fact that in corrugating copper material, which is not very ductile, extra material must be provided to permit "gathering" of material to form the corrugations. From simple geometry, if a flat material is to be formed into a "hill and dale" topography, more material will be required to per linear dimension than if the topography were flat.

In the conventional single lead corrugation process, the copper shield is fed at a rate faster than line speed to provide the incremental material needed for the gathering process. As the single lead corrugating die spins around the cable, it is able to gather the extra copper tubing material and form it into corrugations. However, when attempts were made to speed the copper shield corrugating line by the use of dual lead corrugation, the process was unsuccessful.

We reasoned that by using more ductile full soft aluminum material and thinning it to a dimension at which it became highly malleable, the corrugations would not be formed primarily by "gathering", but rather primarily by permanently stretching or deforming the tubular shield material. If we were able to modify the corrugating process from gathering to deforming as a result of the use of a highly ductile material, dual-lead or even tri-lead corrugating should be feasible. We tried it and it worked.

By forming the cable from thin-walled, full soft aluminum using a dual lead corrugating process, we were able to achieve a product manufacturable at line speeds approximately twice that of conventional helical corrugated cable with flexibility much greater than smooth-walled cable, and electrical performance much greater than that of braided shield cable.

Water Blocking

As will be described in more detail below, in accordance with another aspect of the present invention, to achieve electrical performance and flexibility comparable to helical corrugated copper cable, we sought a highly ductile outer shield which, when helically corrugated, would not, as copper does when corrugated, produce moisture propagating air gaps or passageways between the shield and the foam dielectric which impair electrical performance. During manufacture, the copper material must be free from compressive contact with the surface of the foam so that the copper material can be fed faster than the foam dielectric and can be "gathered".

Because the copper material must be free, once the copper is gathered and corrugated it cannot be pushed far enough into the foam to prevent formation of air gaps or passageways. If the copper material were caused to compress the insulator during the gathering process sufficiently to prevent the formation of air gaps or passageways, the gathering process would fail. However, because a thin-walled aluminum shield is deformable, as will be explained, in the process of the present invention the foam insulator is sufficiently compressed so that no substantial air gaps or passageways are formed.

As will become evident, in the manufacturing process of the present invention, whether applied to helical corrugated or annular corrugated cable, a very different technique is used than is practiced in the conventional helical or annular corrugations arts. Rather than deliberately creating an air space between the shield and dielectric to permit shield material to be "gathered", according to the present invention, no such space is formed or permitted.

Rather, the sheet material from which the shield is formed and seam welded is deliberately formed with a smaller inner diameter than the outer diameter of the foam dielectric. This places the dielectric under compression before the corrugation process is initiated. To our personal knowledge, this step is original and completely unique in the industry. This step is possible only because, according to the present invention, the sheet material from which the shield is formed is unusually thin and composed of a highly ductile material such as aluminum.

The thus-created highly ductile shield material is deformed directly into the already compressed dielectric to form corrugations, which deeply penetrate into the dielectric and prevent the formation of fluid-migration air gaps or passageways. This is true whether the invention is applied to helical corrugated or annular corrugated cable product. As applied to helical corrugated product, the result is water blocking performance far superior to that of conventional helical corrugated cable or braided cable. As applied to annular corrugated product, the already superior water blocking performance is significantly improved.

A prior art cable is depicted in FIG. 1*a*. The coaxial cable of FIG. 1*a* has an inner conductor 10, a dielectric foam insulator 12 that surrounds the inner conductor 10, and a tubular shield 14 surrounding the foam insulator 12. The shield 14 serves as the outer conductor. The shield 14 has corrugations 16 which compress the foam insulator 104, but as explained above, leave air gaps 20 between the foam insulator 12 and the shield 14. The coaxial cable may also have a jacket 18 that surrounds the shield 14. Angle 22 is the pitch angle of the helical shield corrugations.

The use, according to an aspect of the present invention, of aluminum or aluminum alloy, preferably full soft, as the base material for the shield and rolling it to extraordinary thin dimensions (less than about 0.012 inch in larger cable sizes, for example) produces a highly ductile shield which can be deformed into the foam dielectric so tightly as to create an effective barrier to permeation of moisture and fluids into and through the cable. The depth of the corrugations cannot be so great as to produce excessive compression of the foam dielectric. Such could produce localized increases in the specific gravity of the foam, which could impair the electrical properties of the cable.

In summary the cable of the present invention represents a unique integration of a number composition, structural configuration and manufacturing factors. This invention provides a coaxial cable with electrical performance and flexibility comparable to copper corrugated products, manufacturing cost comparable to that of braided shield cable, and water blocking comparable to annual corrugated cable.

In a preferred form the cable of this invention is, we believe, the first all-aluminum, corrugated coaxial cable—a cable that has the lowest cost ever for a cable of comparable electrical performance and flexibility.

Figure 1B:
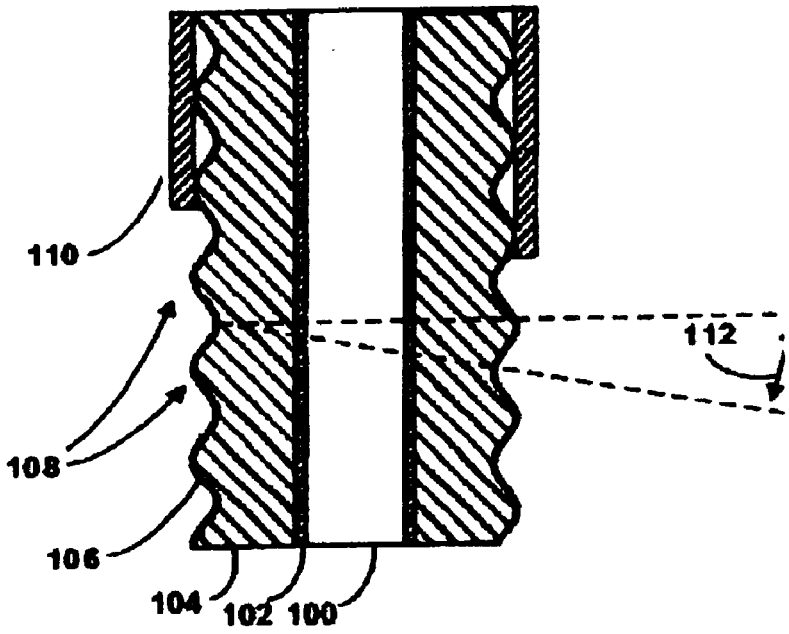
FIG. 1*b* is a drawing depicting the various components of an embodiment of a single lead helical coaxial cable according to the present invention.

A single lead embodiment of a coaxial cable according to the invention is depicted in FIG. 1*b*. The coaxial cable of FIG. 1*b* has an inner conductor 100, a dielectric foam insulator 104 that surrounds the inner conductor 100, and a tubular shield 106 surrounding the foam insulator 104. The shield 106, serving as the outer conductor, may be a thin strip of ductile material with a longitudinal high frequency weld seam. The shield 106 has corrugations 108 which tightly compress the foam insulator 104. The compression of the foam insulator 104 substantially eliminates the formation of fluid propagating air gaps or passageways between the shield 106 and the insulator 104. The coaxial cable may also have a jacket 110 that surrounds the shield 106. The angle 112 is the pitch angle of the shield corrugations.

Figure 1C:
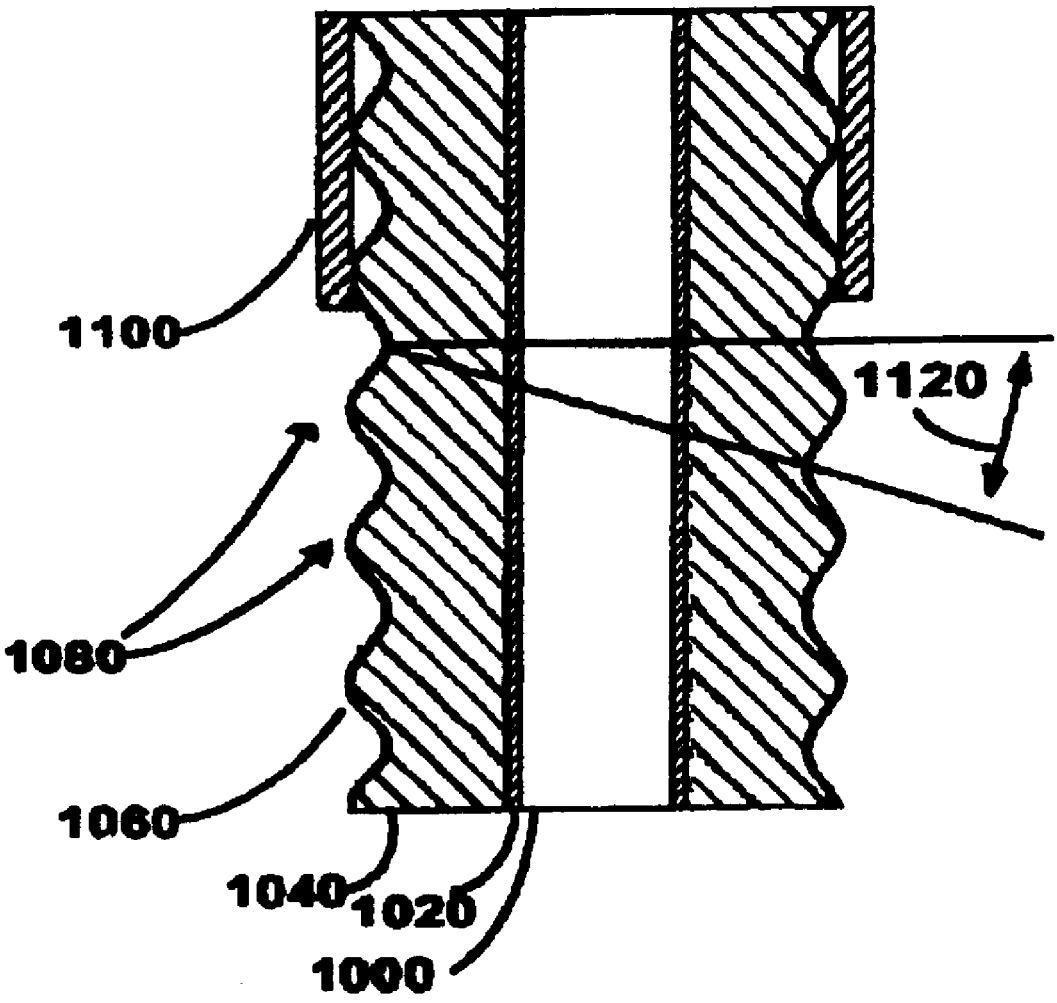
FIG. 1*c* is a drawing depicting the various components of an embodiment of a dual lead helical coaxial cable according to the present invention.

A dual lead embodiment of a coaxial cable according to the invention is depicted in FIG. 1*c*. The coaxial cable of FIG. 1*c* has an inner conductor 1000, a dielectric foam insulator 1040 that surrounds the inner conductor 1000, and a tubular shield 1060 surrounding the foam insulator 1040. The shield 1060, serving as the outer conductor, may be a thin strip of ductile material with a longitudinal high frequency weld seam. The shield 1060 has corrugations 1080 which tightly compress the foam insulator 1040. The compression of the foam insulator 1040 substantially eliminates the formation of fluid propagating air gaps or passageways between the shield 1060 and the insulator 1040. The coaxial cable may also have a jacket 1100 that surrounds the shield 1060. The angle 1120 is the pitch angle of the shield corrugations.

In various embodiments of the coaxial cable, the shield 106 may be composed of aluminum or aluminum alloy, and may have a thickness no greater than about 12 mils in larger diameter cables. The corrugations 108 are helical with a pre-determined pitch. The inner conductor 100 may be composed of aluminum, aluminum alloy, steel, etc. and the inner conductor may have a cladding 102 of high conductivity material, such as copper, silver, etc. The corrugations 108 on the shield 106 preferably form a dual-lead helix for the reasons given.

In an all-aluminum embodiment of a coaxial cable, the inner conductor 100 is composed of aluminum or an aluminum alloy, and the tubular shield 106 around the foam insulator 104 is composed of a strip of thin aluminum or aluminum alloy with a longitudinal high frequency weld seam. The shield 106 preferably has dual-lead helical corrugations 108 that tightly compress the foam, suppressing formation of fluid propagating air gaps or passageways between the shield 106 and the insulator 104. Although the inner conductor 100 in some embodiments may have a cladding of a high conductivity material, it is still termed an all aluminum coaxial cable because both the inner and outer conductors are formed of aluminum or aluminum alloy.

The coaxial cable has performance advantages over competitive braided shielded cable by the provision of the thin tubular aluminum or aluminum alloy shield, which does not wick fluids entering the cable, provides superior electrical shielding, intermodulation interference suppression, VSWR factor, and improved crush strength. Also, the cable has performance advantages over competitive braided shielded cable due to the ductility of the thin walled shield welded with high frequency welding that enables the corrugations to tightly compress the insulator to suppress the creation of fluid propagating air gaps or passageways. Furthermore, embodiments of the coaxial cable are comparable in cost to braided shielded cables due to the ability to use high line speeds in manufacturing. These high line speeds are possible because of the characteristics of high frequency welding of smooth wall cable, and of formation of dual lead corrugations. The use of low cost aluminum or aluminum alloy material in the shield also contributes to the coaxial cables being cost competitive with braided cables.

Figure 2:
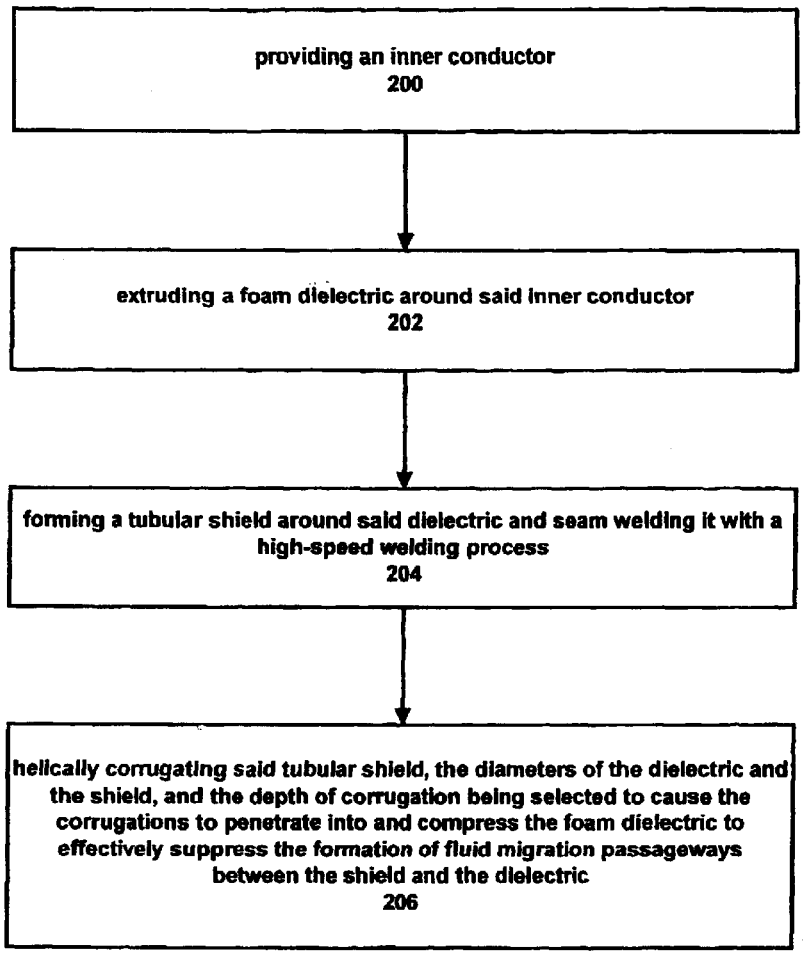
FIG. 2 is a flow diagram depicting the steps of one execution of the method for manufacturing a coaxial cable following the teachings of this invention.

In general terms the method for producing the coaxial cable is depicted in a flow diagram in FIG. 2. The method has the steps of: providing an inner conductor (step 200); extruding a foam dielectric around said inner conductor (step 202); forming a tubular shield around said dielectric and seam welding it with a high-speed welding process (step 204); and helically corrugating said tubular shield, the diameters of the dielectric and the shield, and the depth of corrugation being selected to cause the corrugations to penetrate into and compress the foam dielectric to effectively suppress the formation of fluid migration passageways between the shield and the dielectric (step 206).

Figure 3:
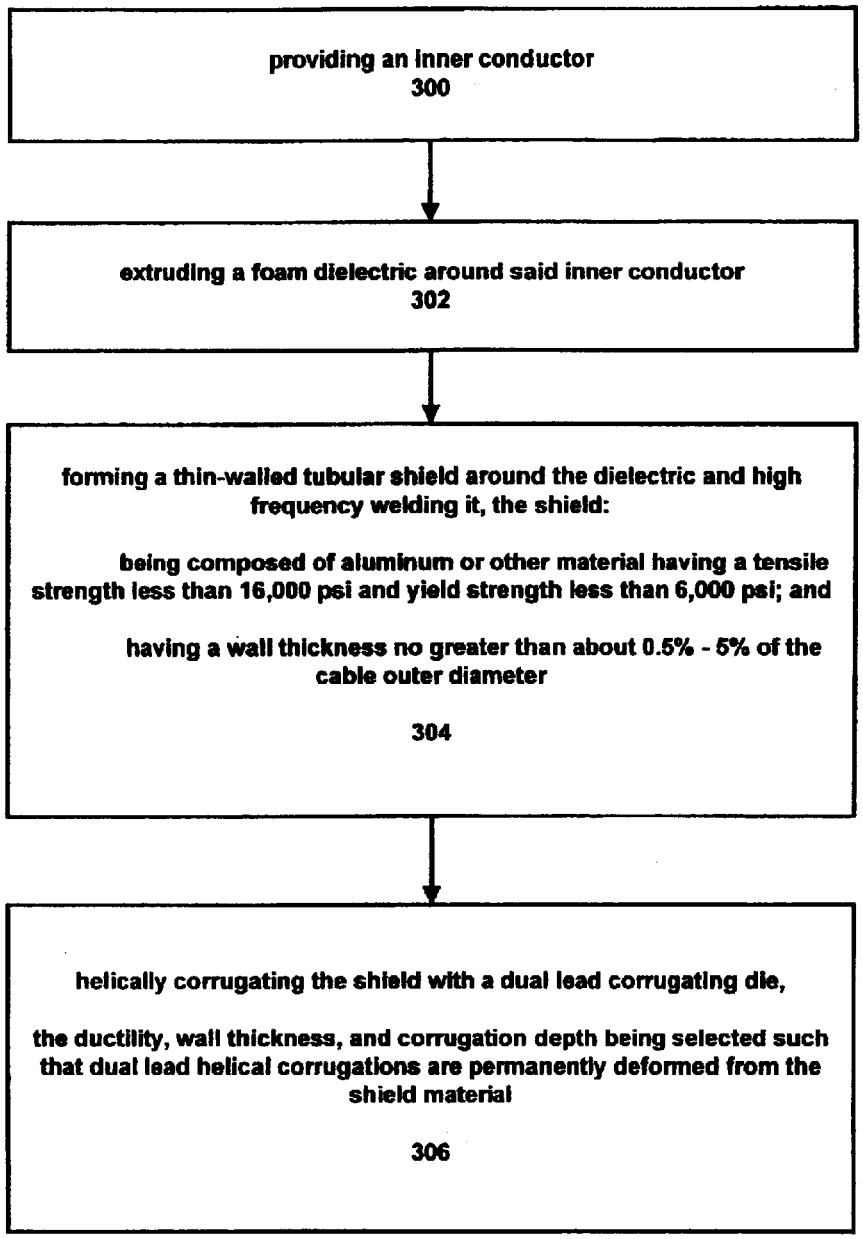
FIG. 3 is a flow diagram depicting the steps of another execution of the method of this invention for manufacturing a coaxial cable.

FIG. 3 is a flow chart depicting an embodiment of the method of making low cost, high performance coaxial cables having the steps of: providing an inner conductor (step 300), extruding a foam dielectric around the inner conductor (step 302), forming a thin-walled tubular shield around the dielectric and high frequency welding it, the shield being composed of aluminum or other material having a tensile strength less than 16,000 psi and yield strength less than 6,000 psi, the shield also having a wall thickness no greater than about 0.5%–5% of the cable outer diameter (step 304), helically corrugating the shield with a dual lead corrugating die, the ductility, wall thickness, and corrugation depth being selected such that dual lead helical corrugations are permanently deformed from the shield material (step 306). In various embodiments of the method, the strip may comprise aluminum or aluminum alloy, the strip may have a thickness no greater than about 12 mils, the inner conductor may be composed of aluminum, aluminum alloy, or steel, etc., and the inner conductor may have a cladding of copper, silver, or other high conductivity material. The line speed for manufacturing the single lead coaxial cable and performing each of the steps in the method may in general be approximately twice that of annular corrugation line speeds, and for dual lead cable as much as approximately four times that of annular corrugation line speeds. Also, the step of corrugating the shield may be a corrugating step that creates a single lead or a dual lead helical corrugation having a predetermined pitch. The dual lead helix translates into more pronounced pitch angle and faster line speeds, and therefore lower cost.

The process provides performance advantages over competitive braided shielded cable by the provision of a thin tubular aluminum or aluminum alloy shield, which does not wick fluids entering the cable, which provides superior electrical shielding, intermodulation interference suppression, VSWR factor, and superior mechanical shielding. The process also provides performance advantages due to the ductility of the thin walled shield welded with high frequency welding. The aluminum in the shield enables the corrugations to tightly compress the insulator to suppress the creation of fluid propagating air gaps or passageways. The process also provides cost comparable to braided shielded cable by the use of high frequency welding of smooth wall cable, the use of a high pitch corrugating operation, especially dual lead corrugation, and the use of low cost aluminum or aluminum alloy material in the shield where electrical resistance is less critical than in the inner conductor.

The cable of the present invention has numerous features and advantages. In general the cable has an inner conductor; a foam dielectric surrounding the inner conductor; a tubular shield surrounding the dielectric, the shield having helical corrugations penetrating into and compressing the foam dielectric to effectively suppress the formation of fluid migration passageways between the shield and the dielectric. The depth of the corrugations is configured to produce compression of the dielectric at substantially all points along the cable. In an embodiment of the cable the depth of compression is at least 2 percent of the cable outer diameter. The depth of compression preferably varies along the shield corrugations between about 2–11 percent of the cable outer diameter. Furthermore, the outer diameter of the dielectric is greater prior to forming the shield than the greatest inner diameter of the shield after forming.

The helical corrugations may also be dual lead and have a dual lead pitch angle in the range of 10 to 45 degrees, measured relative to a line orthogonal to the longitudinal axis of the cable. The pitch angle of the dual lead is within 20 percent of the outer diameter of the cable. The helical corrugation may also be single lead with a pitch angle in the range of 5 to 35 degrees, measured relative to a line orthogonal to the longitudinal axis of the cable.

The shield is composed of a ductile material, wherein the corrugations are created during the corrugating process primarily by permanently deforming, rather than primarily by gathering, the shield material. The helical pitch and depth of corrugation are selected such that the per unit length extension of the cable outer conductor produced by the deforming corrugation process is at least about 4% percent, and preferably in the range of about 4 to 12 percent. The shield material may be formed of aluminum or aluminum alloy. The inner conductor may be composed of copper clad aluminum. The wall thickness of the shield is preferably between about 0.5 to 5 percent of the cable outer diameter.

In the cable a fluid-block intervention is included between the shield and the dielectric to enhance the water blocking performance of the cable. The intervention is selected from the group consisting of a hygroscopic material, an adhesive, grease or other flooding compound. Also, the shield has an HF-welded longitudinal seam.

Specifications of Preferred Executions

HC600 (.6 inch Outside Diameter Cable)

| | |
|---|---|
| Inner Conductor: | copper clad aluminum, 0.189" OD |
| Dielectric: | foam polyethylene, 0.545" OD, 0.155 specific gravity |
| Outer Conductor: | seam welded aluminum, 0.010" thick, OD = 0.550"<br>helical corrug depth: 0.045", dual lead pitch: .5" |

-continued

| Specifications of Preferred Executions | |
|---|---|
| Jacket: | black polyethylene, 0.600" OD |
| Depth of compression at least 2 percent of the cable outer diameter | |
| HC400 (.4 inch Outside Diameter Cable) | |
| Inner Conductor: | copper clad aluminum, 0.118" OD |
| Dielectric: | foam polyethylene, 0.353" OD, 0.18 specific gravity |
| Outer Conductor: | seam welded aluminum, 0.008" thick, OD = 0.360" helical corrug depth: 0.035", dual lead pitch: .4" |
| Jacket: | black polyethylene, 0.405" OD |
| Depth of compression at least 2 percent of the cable outer diameter | |
| HC240 (.24 inch Outside Diameter Cable) | |
| Inner Conductor: | copper clad aluminum, 0.063" OD |
| Dielectric: | foam polyethylene, 0.202" OD, 0.2 specific gravity |
| Outer Conductor: | seam welded aluminum, 0.006" thick, OD = 0.208" helical corrug depth: 0.025", dual lead pitch: .230" |
| Jacket: | black polyethylene, 0.250" OD |
| Depth of compression at least 2 percent of the cable outer diameter | |

Alternatives, Modification, and Other Specifications

Whereas the principles of the invention have been described as most suitably applied to helical corrugated coaxial cable because of the significantly lower cost of manufacture of helical corrugated cable, particularly multi-lead helical corrugated cable, the invention may also be advantageously applied to annular corrugated cable.

As applied to annular corrugated cable, the end product has a cross-sectional configuration as shown in FIG. 1*c*. The depth of corrugation of the annular corrugations, as shown, penetrates into and compresses the foam dielectric to effectively suppress the formation of fluid migration air gaps or passageways between the shield and the dielectric. For maximum water blocking performance, would exists no air gaps or passageways formed between the shield and the dielectric, as shown. In applications where maximum water blocking performance is not required, the compression level need not be so great and small air gaps or passageways may be permissible.

The description and specifications for the annular corrugated execution of the invention relating to material composition, outer conductor wall thickness, foam dielectric type and material, etc. may be similar to those described above for the helical corrugated embodiments of the invention, except those related to the helical corrugated nature of the cable.

In accordance with the present invention, for greater performance, rather than employing pure aluminum as base material for the inner conductor, a solid copper wire or tube may be employed, and for the outer conductor (shield) a copper coating or cladding may be employed on the inner surface.

The range of thickness for the outer conductor will vary with the diameter of the cable, and is preferably no greater than about 0.012 inch for larger diameter cables. At the lower end, for smaller diameter cable the minimum wall thickness will be limited by the need for structural strength and weldability, but may be 0.004 inch or less.

The preferred welding process is HF, but other high speed processes such as laser welding, ultrasonic welding, etc., may be used, depending upon the application.

The corrugating step is preferably dual lead helical, but may also be single lead, or may be tri-lead or higher.

Whereas the water blocking properties of the cable of the invention are impressive without the use of adhesive between the shield and dielectric, for high pressure water ingress protection, in special applications hygroscopic material, adhesive, grease, or other flooding compounds could be employed to enhance the water blocking properties of the cable.

The coaxial cable may be made and configured for a large variety of applications. For example, it is advantageously utilized to produce both 50 ohm and 75 ohm coaxial cables.

The present invention is not limited to the particular details of the method and apparatus depicted and other modifications and applications are contemplated. Certain other changes may be made in the above-described method and apparatus without departing from the true spirit and scope of the invention herein involved. For example, the inner conductor may be composed of various materials, and not limited to aluminum, aluminum alloy, or steel. Also, the cladding of the inner conductor is not limited to copper and silver, but may include many other high conductivity materials. The corrugations in the outer shield may have other configurations and forms other than single and dual lead helix. The dielectric foam insulator may be composed of various materials that effect insulation between the inner conductor and the outer conductor or shield. The outer conductor or shield may be formed in other manners than the welding of the strip in a high speed, high frequency welding operation. It is intended, therefore, that the subject matter in the above depiction shall be interpreted as illustrative and not in a limiting sense.

What is claimed is:

1. A process of manufacturing a high performance, water blocking dual lead helical coaxial cable, comprising:

a. providing an inner conductor;

b. extruding a foam dielectric around said inner conductor;

c. forming a tubular shield around said dielectric and seam welding it with the shield compressing the dielectric to suppress the formation of an air gap between the shield and the dielectric; and d. corrugating said tubular shield to further compress the dielectric, and e. selecting the diameters of the dielectric and the shield, and the depth of corrugation and employing a dual lead helical corrugating to cause the corrugations to penetrate deeply into and compress the foam dielectric to effectively suppress a formation of fluid migration air gaps or passageways between the shield and the dielectric, thereby forming dual lead helical corrugation coaxial cable.

2. The cable manufacturing process defined by claim 1 wherein the depth of corrugation is effective to produce compression of said dielectric at substantially all points along the cable.

3. The cable manufacturing process defined by claim 2 wherein said depth of compression is at least 2 percent of the cable outer diameter.

4. The cable manufacturing process defined by claim 3 wherein said depth of compression varies along the shield corrugations between about 2–11 percent of the cable outer diameter.

5. The cable manufacturing process defined by claim 2 wherein the outer diameter of said dielectric before the shield is formed is greater than the greatest inner diameter of the shield after the shield is formed.

6. The cable manufacturing process defined by claim 1 wherein said helical corrugations have a dual lead pitch angle in the range of 10 to 45 degrees, measured from a line orthogonal to a longitudinal axis of the cable.

7. The cable manufacturing process defined by claim 1 wherein the pitch of said dual lead is within 20 percent of the outer diameter of the cable.

8. The cable manufacturing process defined by claim 1 wherein said shield is composed of a ductile material, and wherein said corrugations are created during the corrugating process primarily by permanently deforming, rather than by primarily gathering, said shield material.

9. The cable manufacturing process defined by claim 1 wherein helical pitch and depth of corrugation are selected such that a per unit length extension of the cable outer conductor produced by the said deforming corrugation process is at least about 4% percent.

10. The cable manufacturing process defined by claim 9 wherein said extension is about 4–12 percent.

11. The cable manufacturing process defined by claim 1 wherein said shield material is aluminum or aluminum alloy.

12. The cable manufacturing process defined by claim 1 wherein said inner conductor is composed of copper clad aluminum.

13. The cable manufacturing process defined by claim 1 wherein the wall thickness of said shield is between about 0.5 to 5 percent of the cable outer diameter.

14. The cable manufacturing process defined by claim 1 wherein a fluid-block intervention is included between said shield and said dielectric to enhance the water blocking performance of the cable manufacturing process, said intervention is selected from the group consisting of a grease.

15. The cable manufacturing process defined by claim 1 wherein said high speed welding process comprises high frequency welding.

16. The cable manufacturing process defined by claim 1 wherein the speed of said manufacturing process is approximately twice of the speed of manufacturing process of single lead helical corrugation cable.

* * * * *